US006228318B1

(12) United States Patent
Nakamae et al.

(10) Patent No.: US 6,228,318 B1
(45) Date of Patent: May 8, 2001

(54) MANUFACTURING METHOD OF CERAMICS COMPONENT HAVING MICROSTRUCTURE

(75) Inventors: Kazuo Nakamae; Yoshihiro Hirata, both of Hyogo (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/533,374

(22) Filed: Mar. 22, 2000

(30) Foreign Application Priority Data

Mar. 24, 1999 (JP) ..... 11-079682

(51) Int. Cl.[7] ..... B28B 3/00
(52) U.S. Cl. ..... 264/642; 264/643; 264/667
(58) Field of Search ..... 264/642, 643, 264/667, 669

(56) References Cited

U.S. PATENT DOCUMENTS 5,075,053 * 12/1991 Bernadic et al. ..... 264/125
5,676,906 10/1997 Hirata ..... 264/430

* cited by examiner

*Primary Examiner*—Christopher A. Fiorilla
(74) *Attorney, Agent, or Firm*—McDermott, Will & Emery

(57) ABSTRACT

In a method for manufacturing ceramic components, a resin mold is initially filled with a paste containing a ceramic material. Next, a ceramic powder is applied on the paste. The ceramic powder and paste are then press-formed and removed from the resin mold. Finally, the ceramic powder and paste are baked. The method allows manufacturing of ceramic components having a microstructure without collapse. Additionally, ceramic components having a large area can be manufactured without warping.

10 Claims, 8 Drawing Sheets

MANUFACTURING METHOD OF CERAMICS COMPONENT HAVING MICROSTRUCTURE

BACKGROUND OF THE INVENTION

1. Field of the Invention

The present invention relates to a manufacturing method of a ceramics component having a microstructure used in various fields of industry, for example, a manufacturing method of a ceramics component having a microstructure such as a composite piezoelectric material.

2. Description of the Background Art

FIG. 1 is a perspective view showing a structure of a composite piezoelectric material 21 as an example of a ceramics component having a microstructure.

Referring to FIG. 1, composite piezoelectric material 21 has a structure in which piezoelectric ceramics columns 22 are formed in a resin 23.

The conventional manufacturing of a composite piezoelectric material of such a structure includes the method of employing mechanical working such as cutting and abrasion, the process by laser abrasion as well as the method of using a mold with a microscopic pattern formed in the resin as disclosed in U.S. Pat. No. 5,676,906.

FIGS. 2–8 are sectional views showing an example of a manufacturing method of a ceramics component with a forest of microscopic columns, disclosed in U.S. Pat. No. 5,676,906.

Referring to FIG. 2, deep X-ray lithography is effected by directing synchrotron radiation (SR) 40 onto a conductive substrate 1 coated with a resist 2 that has sensitivity to X-ray through a mask 3 for X-ray lithography.

As X-ray lithography mask 3, a mask of a relatively thick absorber can be used formed of, for example, silicon nitride having a thickness of 2 $\mu$m as a support film 31 and tungsten having a thickness of 5 $\mu$m as an absorber pattern 32. Alternatively, nickel mesh having a thickness of at least 30 $\mu$m can be used.

Referring to FIG. 3, a resist structure 4 is produced by a development process.

Referring to FIG. 4, nickel plating is applied on resist structure 4 to produce a nickel mold 5. Then, resist structure 4 is removed.

Referring to FIG. 5, resin molding is effected using the produced nickel mold 5 to form a resin mold 6. This resin mold 6 can be configured to have, for example, a hole of 25 $\mu$m square and 300 $\mu$m in depth arranged in a two dimensional manner at the pitch of 50 $\mu$m.

Referring to FIG. 6, a ceramics slurry 17 is poured into resin mold 6 and then dried.

Referring to FIG. 7, resin mold 6 is removed by plasma 50.

Referring to FIG. 8, the binder is removed and baking is effected to obtain a ceramics structure 9 with many columns.

According to the conventional art disclosed in the above U.S. Pat. No. 5,676,906, there is a possibility of the microstructure collapsing due to the insufficient strength during removal of the resin mold if the solvent ratio of the used ceramics slurry is high. The structure subjected to the baking process becomes porous with the possibility of inducing problems from the standpoint of property and strength.

Furthermore, according to the conventional art, there was a case where warping occurs during baking since the shape differs between the top face and the bottom face of the ceramics component depending upon the absence/presence of a resin mold. It was extremely difficult to suppress such warping. Therefore, it was not easy to fabricate a ceramics component of a large area by the conventional method.

SUMMARY OF THE INVENTION

An object of the present invention is to solve the above problems, and provide a method of manufacturing a ceramics component of a microstructure without collapse, and also of a large area suppressed in generation of warping.

According to an aspect of the present invention, a manufacturing method of a ceramics component having a microstructure is provided. This manufacturing method includes the steps of filling a resin mold with ceramics paste, apply press-forming with ceramics powder placed on the ceramics paste, and baking after the resin mold is removed.

According to the present invention, paste (the state of the raw material of ceramics used in extrusion) is placed on a resin mold. Powder (the state of the raw material used in press-forming) is provided therearound, and press-forming is applied. Since the paste has a solvent ratio lower than that of a slurry, collapse of the ceramics microstructure and problems of the property and strength are solved. Paste is inferior than slurry from the standpoint of fluidity due to the low solvent ratio. However pressure can be applied by virtue of providing powder, whereby injection into a microscopic hole is possible.

According to the present invention, generation of warping can be suppressed. By virtue of the double layer structure of paste and powder, the warping caused by difference in the shape between the top face and the bottom face can be canceled by controlling each shrinkage rate of the two layers. More specifically, generation of warping can be suppressed by optimizing the injection pressure or paste composition, increasing the shrinkage rate of the powder portion by mixing excessively large particles into the powder portion, and the like.

According to the present invention, a ceramics microstructure can be fabricated without collapse. Also, suppression of warping allows manufacturing of a ceramics component of a large area.

Preferably, microscopic particles obtained by pulverizing a baked structure of a ceramics material of a type identical to that of the ceramics component is mixed into the ceramics powder.

By setting the type of the ceramics powder identical to that of the ceramics component, change in the property of the component can be prevented even if ceramics powder is mixed into the ceramics component during the manufacturing process.

Further preferably, the microscopic particle obtained by pulverizing the ceramics material baked structure of a type identical to that of the ceramics component is mixed 0–30 wt % in the ceramics powder.

If the amount of microscopic particles mixed becomes greater than 30 wt %, sufficient press-forming cannot be achieved. The handling thereafter will become difficult to induce the possibility of a problem during the manufacturing process.

Also preferably, the amount of binder included in the ceramics paste is 3–30 vol % with respect to the entire ceramics paste, and the amount of solvent is 40–45 vol % with respect to the entire ceramics paste.

If the amount of binder is less than 3 vol %, there may be difficulty in maintaining the microstructure when the resin mold is removed. If the amount of binder is greater than 30 vol %, there may be difficulty in maintaining the microstructure after removing the binder.

Furthermore, if the amount of solvent is less than 40 vol %, the paste will become too hard to be introduced into the resin mold. If the amount of solvent is greater than 45 vol %, it will be difficult to maintain the microstructure after removing the binder.

Preferably, the pressure is to be adjusted to 250–3200 kgf/cm$^2$ in the press-forming step.

Further preferably, the pressure is to be adjusted to 250–3000 kgf/cm$^2$ in the press-forming step.

If this pressure is lower than 250 kgf/cm$^2$, sufficient press-forming cannot be achieved to cause a problem during the manufacturing process. If the pressure becomes 3200 kgf/cm$^2$ or greater, the difference in density between the particles of the ceramics paste and the base becomes so large that warping or peeling will occur.

As to ceramics paste of a viscosity that facilitates the blending process and injection into a resin mold, the pressure range of 250–3000 kgf/cm$^2$ is preferable for press-forming Preferably, the ceramics powder placed on the paste is adjusted to have a thickness of 1–5 mm after the press-forming step.

It is extremely difficult to set the thickness of the ceramics powder smaller than 1 mm by the current processing technique. If the thickness is set greater than 5 mm, the pressure applied in the press-forming step in the upward direction and the downward direction will be effected only at the surface and not conveyed to the interior. This will induce the problem of the generation of a crack or the like.

Preferably, the thickness of the ceramics paste introduced into the resin mold is preferably set uniform.

If the thickness of the ceramic paste is not uniform, baking will be effected with an undulation surface due to the shrinkage difference between the ceramics paste and base depending upon the location.

Preferably, the ceramics paste introduced into the resin mold is preferably 0.5–3 mm in thickness.

Further preferably, the ceramics paste introduced into the resin mold is 1–3 mm in thickness.

It is extremely difficult to set the thickness of the ceramics paste smaller than 0.5 mm from the current processing technique. If the thickness is set greater than 3 mm, there is a possibility that the ceramics paste will be extruded up to the side of the resin mold during the press-forming step.

The reason why the ceramics paste thickness is set to the range of 1–3 mm is that the sheet thickness of ceramics paste that can be easily handled during the manufacturing process without any injection defect into the resin mold is 1–3 mm. Also, ceramics paste thinner than 1 mm may induce the problem of injection defect or difficulty in handling. Injection defect implies an insufficient portion where the hole in the resin mold is not completely filled.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

FIGS. 9–17 are sectional views of a composite piezoelectric element showing a manufacturing method thereof as an example of a manufacturing method of a ceramics component having a microstructure of the present invention.

Figure 1:
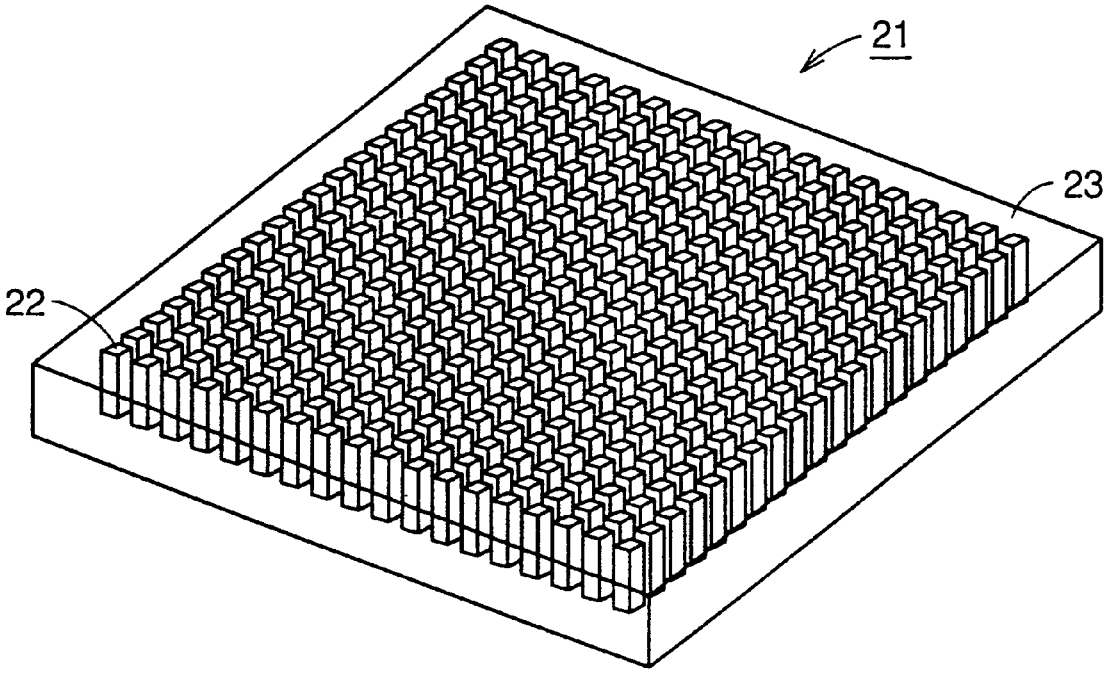
FIG. 1 is a perspective view of a structure of a composite piezoelectric material as an example of a ceramics component having a microstructure.
Figure 2:
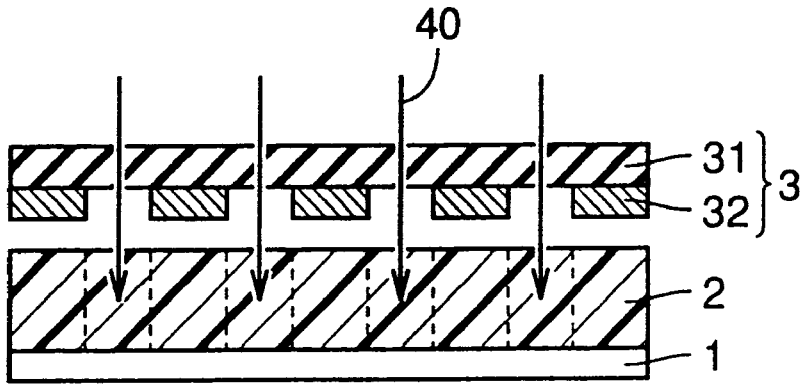
FIG. 2 PRIOR ART
FIGS. 2–8 are sectional views of a ceramics component with a forest of microscopic columns corresponding to a prior art example of a manufacturing method thereof.
Figure 3:
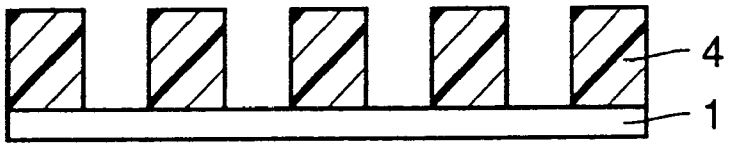
FIG. 3 PRIOR ART
Figure 4:
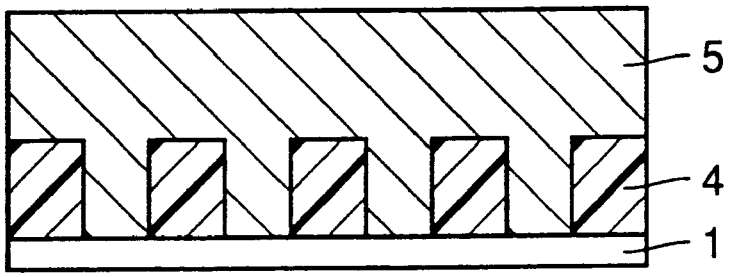
FIG. 4 PRIOR ART
Figure 5:
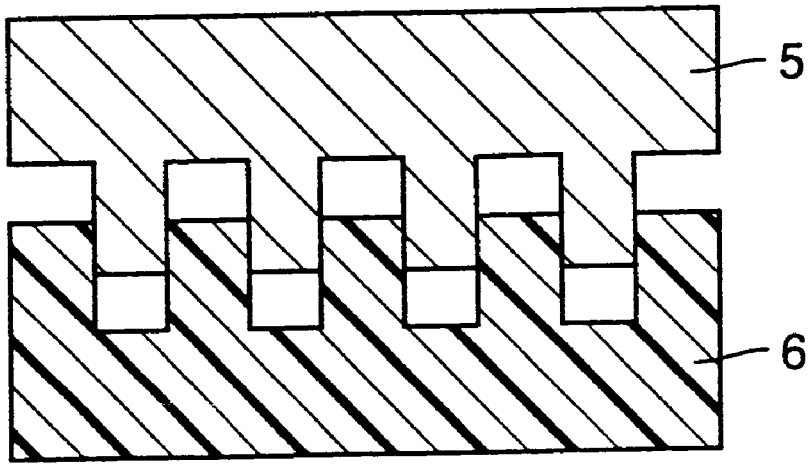
FIG. 5 PRIOR ART
Figure 6:
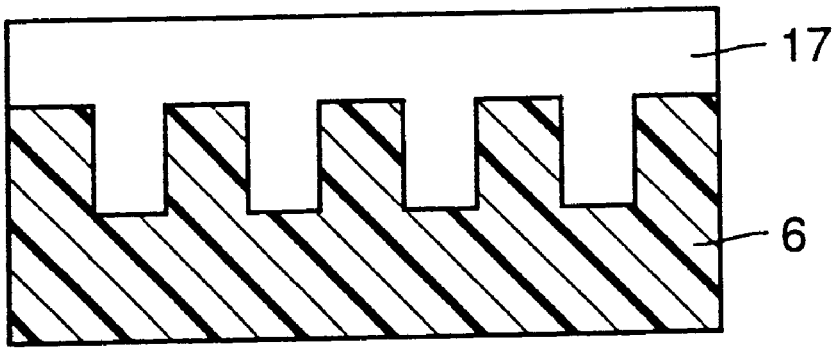
FIG. 6 PRIOR ART
Figure 7:
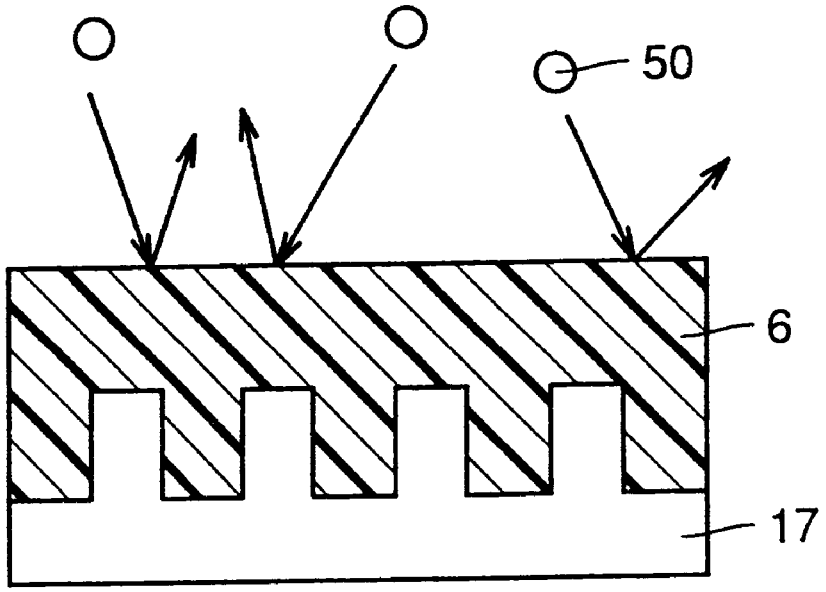
FIG. 7 PRIOR ART
Figure 8:
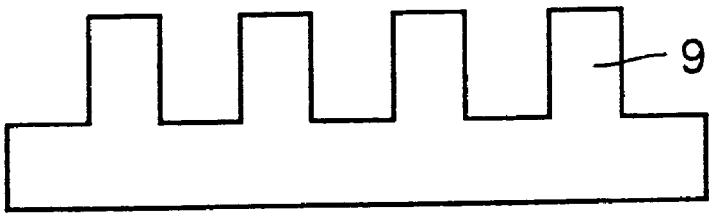
FIG. 8 PRIOR ART
Figure 9:
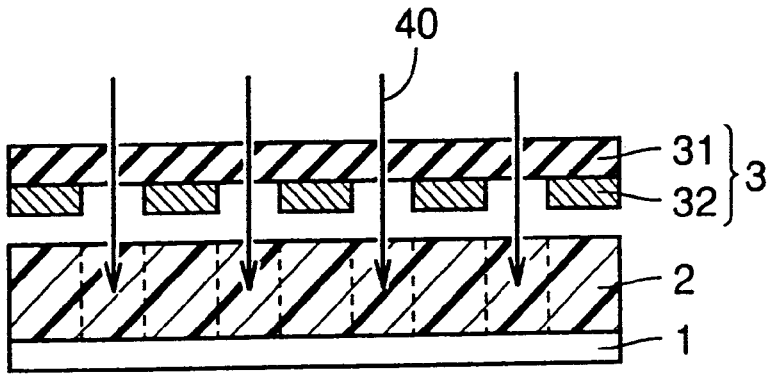
FIGS. 9–17 are sectional views of a composite piezoelectric element showing a manufacturing method thereof as an example of a manufacturing method of a ceramics component having a microstructure of the present invention.

Referring to FIG. 9, deep X-ray lithography is effected by directing synchrotron radiation (SR) 40 onto a conductive substrate 1 coated with a resist 2 having sensitivity to X-ray through a mask 3 for X-ray lithography.

As an X-ray lithography mask 3, a mask of a relatively thick absorber can be used formed of silicon nitride having a thickness of 2 $\mu$m as a support film 31, and tungsten having a thickness of 5 $\mu$m as an absorber pattern 32. Also, a nickel mesh of at least 30 $\mu$m in thickness can be used as the mask.

Figure 10:
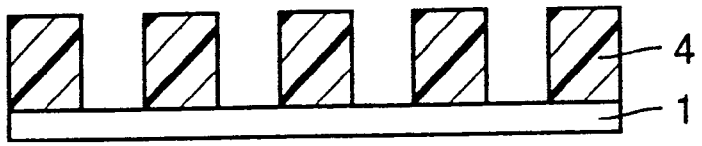

Referring to FIG. 10, a resist structure 4 is produced by a development process.

Figure 11:
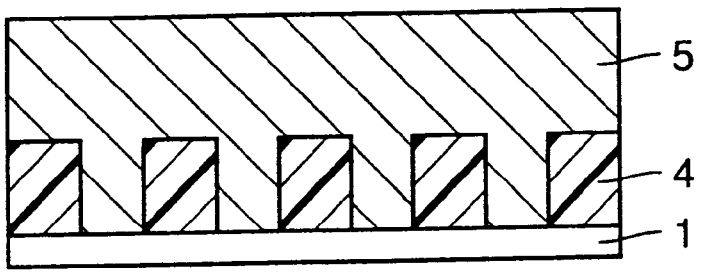

Referring to FIG. 11, nickel plating is applied on resist structure 4 to produce a nickel mold 5. Then, conductive substrate 1 and resist structure 4 are removed.

Figure 12:
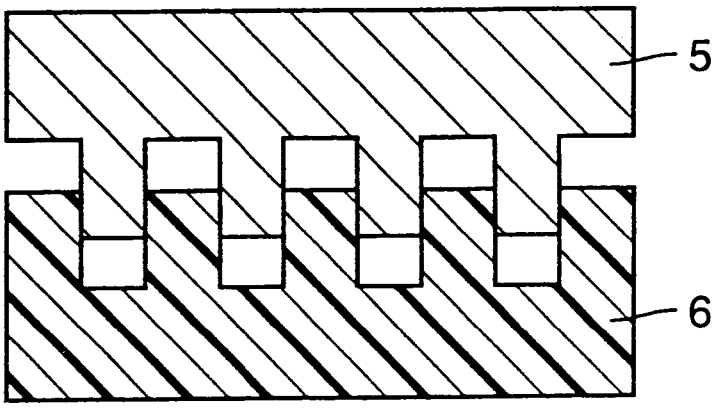

Referring to FIG. 12, resin molding is effected using nickel mold 5 to produce a resin mold 6. This resin-mold 6 can be configured having a hole of 25 $\mu$m square and 300 $\mu$m in depth arranged in a two dimensional manner at a pitch of 50 $\mu$m.

Figure 13:
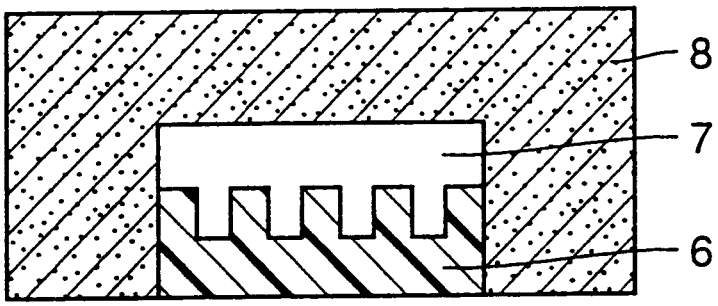

Referring to FIG. 13, ceramic paste 7 is placed as a sheet of 1–3 mm in thickness on resin mold 6. Ceramics powder 8 is provided around the same and placed in a die. Press-forming is applied. The ceramics paste is produced by mixing 3–30 vol % of polyvinyl alcohol powder which is a typical binder and 40–45 vol % of water which is the solvent into ceramics powder. The ceramics powder is produced by mixing 0–30 wt % microscopic powder formed by pulverizing a ceramics baked structure into the ceramics powder. Ceramics powder 8 is adjusted to have a thickness of 1–5 mm after the press step. The press pressure is 250–3000 kgf/cm$^2$.

Figure 14:
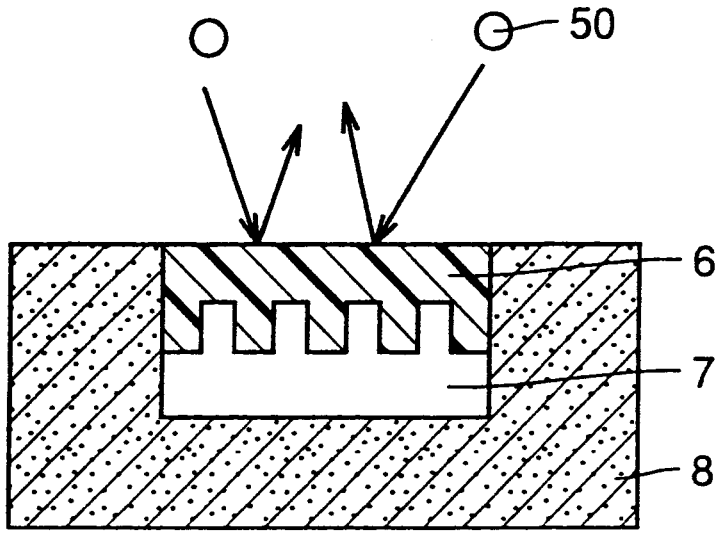

After a drying step, resin mold 6 is removed by plasma 50 as shown in FIG. 14. Here, the collapse ratio of the columnar ceramics is not more than 1%.

Figure 15:
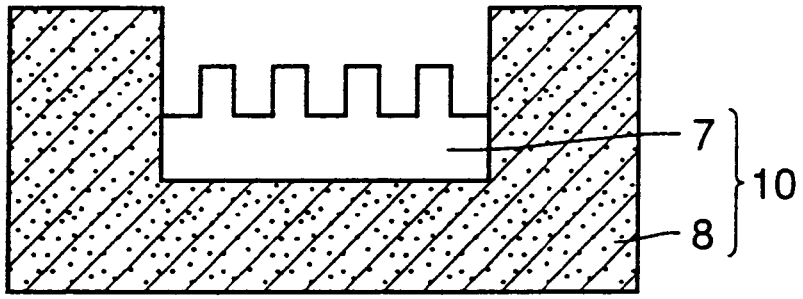

Referring to FIG. 15, the binder is removed and baking carried out to produce a ceramics structure 10. Here, the warp over an arbitrary distance of 20 mm in the obtained ceramics structure 10 is not more than 50 $\mu$m.

Figure 16:
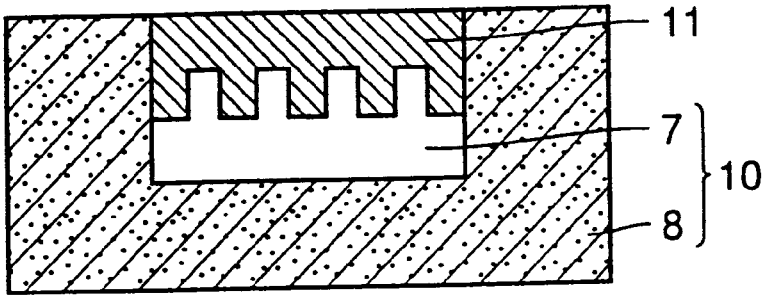

Referring to FIG. 16, epoxy resin 11 is injected into ceramics structure 10 and cured.

Figure 17:
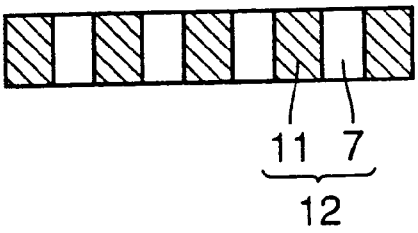

Referring to FIG. 17, grinding is effected to obtain a composite piezoelectric element 12 having a columnar ceramics structure 7 embedded in epoxy resin 11.

According to the present embodiment, the hole of resin mold 6 is sufficiently filled with the soft paste. The paste will not be extruded since the gap of the dice is filled with ceramics powder 8 for press-forming. Also, the possibility of deformation during the handling process is eliminated since ceramic powder 8 subjected to the press process serves to maintain the shape.

According to the present embodiment, generation of warping after baking can be suppressed by optimizing the paste composition, the injection pressure, and blend of excessively large particles into the powder portion.

In the process of achieving the present embodiment, the inventors tried to fill the resin mold with powder press-forming as a method of manufacturing a microscopic ceramic component without using a ceramics slurry. However, the hole of 25 $\mu$m square in the resin mold could be filled only up to the depth of approximately 30 $\mu$m with the ceramics powder.

The inventors made a research of whether the "paste" used in extrusion which is of a state intermediate the ceramics powder and the ceramics slurry could be used or not. Upon placing the resin mold in a die and applying a press process with paste thereon as in the normal powder press-forming process, it was found that the ceramics paste introduced completely in the hole of the resin mold was extruded from the gap (approximately 15 $\mu$m) of the dice. It was found that the ceramics green compact formed of the paste is extremely soft until being dried. The ceramics green compact was easily deformed and difficult to handle.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of manufacturing a ceramic component having a microstructure, comprising the steps of:

filling a resin mold with a paste containing ceramic, applying ceramic powder on said paste, press-forming said ceramic powder and said paste, removing said resin mold, and baking said ceramic powder and said paste after removing said resin mold.

2. The method of manufacturing a ceramic component having a microstructure according to claim 1, wherein said ceramic powder is mixed with microscopic particles obtained by pulverizing a baked structure of a ceramic material identical in type to said ceramic component.

3. The method of manufacturing a ceramic component having a microstructure according to claim 2, wherein said microscopic particles obtained by pulverizing a baked structure of a ceramic material identical in type to said ceramic component is mixed 0–30 wt % in said ceramic powder.

4. The method of manufacturing a ceramic component having a microstructure according to claim 1, wherein said paste includes a binder and solvent, an amount of said binder included in said paste being 3–30 vol % with respect to the entire paste, and an amount of said solvent included in said paste being 40–45 vol % with respect to the entire paste.

5. The method of manufacturing a ceramic component having a microstructure according to claim 1, wherein pressure is adjusted to 250–3200 kgf/cm$^2$ in said press-forming step.

6. The method of manufacturing a ceramic component having a microstructure according to claim 5, wherein pressure is adjusted to 250–3000 kgf/cm$^2$ in said press-forming step.

7. The method of manufacturing a ceramic component having a microstructure according to claim 1, wherein said ceramic powder applied on said paste is set to have a thickness of 1–5 mm after press-forming.

8. The method of manufacturing a ceramic component having a microstructure according to claim 1, wherein said paste is set to have a uniform thickness.

9. The method of manufacturing a ceramic component having a microstructure according to claim 8, wherein said paste is set to have a thickness of 0.5–3 mm.

10. The method of manufacturing a ceramic component having a microstructure according to claim 9, wherein said paste is set to have a thickness of 1–3 mm.

* * * * *